US010107006B2

(12) United States Patent
Ruffino

(10) Patent No.: US 10,107,006 B2
(45) Date of Patent: Oct. 23, 2018

(54) DOOR KNOB ASSEMBLY

(71) Applicant: Anthony C. Ruffino, Staten Island, NY (US)

(72) Inventor: Anthony C. Ruffino, Staten Island, NY (US)

( * ) Notice: Subject to any disclaimer, the term of this patent is extended or adjusted under 35 U.S.C. 154(b) by 545 days.

(21) Appl. No.: 14/737,303

(22) Filed: Jun. 11, 2015

(65) Prior Publication Data

US 2016/0362910 A1 Dec. 15, 2016

(51) Int. Cl.
*E05B 1/00* (2006.01)
*E05B 17/20* (2006.01)
(Continued)

(52) U.S. Cl.
CPC ..... *E05B 1/0038* (2013.01); *E05B 1/0007* (2013.01); *E05B 17/2038* (2013.01);
(Continued)

(58) Field of Classification Search
CPC ..... E05C 1/14; E05C 19/02; E05C 19/028; E05B 1/0007; E05B 1/0015; E05B 1/0038; E05B 1/0053; E05B 3/04; E05B 3/06; E05B 13/004; E05B 13/101; E05B 17/2011; E05B 17/2038; E05B 17/2057; E05B 35/008; E05B 35/06; E05B 63/0069; Y10S 292/27; Y10S 292/44; Y10T 292/06; Y10T 292/0979; Y10T 292/0982; Y10T 292/0983; Y10T 292/0984; Y10T 292/0986; Y10T 292/57; Y10T 292/59; Y10T 292/62; Y10T 292/82; Y10T 292/85; Y10T 292/858; Y10T 292/865; Y10T 292/93; Y10T 292/96; Y10T 70/5296; Y10T 70/5394; Y10T 70/5398; Y10T 70/5407; Y10T 70/5456; Y10T 70/546;
(Continued)

(56) References Cited

U.S. PATENT DOCUMENTS 568,653 A * 9/1896 Ambs ..... E05B 55/00 70/150
776,073 A * 11/1904 Levy ..... E05B 65/0852 292/210
(Continued)

FOREIGN PATENT DOCUMENTS

DE 326872 C * 10/1920 ..... E05C 1/14
DE 805012 C * 5/1951 ..... E05B 35/06
GB 839328 A * 6/1960 ..... E05C 1/06

*Primary Examiner* — Christine M Mills

(57) ABSTRACT

A new door knob assembly for allowing a door to be opened easily without the need to turn a knob. The assembly includes an outside door knob and an actuating inside door knob respectively positioned within openings on the outside and inside surfaces of a door. A locking body which communicates with the door knobs is positioned in an opening on the side edge of the door. The locking body has a locking shaft with a locking head on one end which protrudes from the side edge and retracts into the door. On the other end, engagement arms are fitted with obstruction openings. A locking rod which extends in from the inside knob has a locking nut which when positioned in the obstruction openings prevents the locking head from retracting into the door. When the locking nut is moved out of the obstruction openings by actuating the inside knob the locking head can retract into the door.

4 Claims, 7 Drawing Sheets

(51) Int. Cl.
*E05B 35/00* (2006.01)
*E05B 63/00* (2006.01)
*E05C 19/02* (2006.01)

(52) U.S. Cl.
CPC ..... *E05B 35/008* (2013.01); *E05B 63/0069* (2013.01); *E05C 19/028* (2013.01)

(58) Field of Classification Search
CPC . Y10T 70/5482; Y10T 70/5487; Y10T 70/55; Y10T 70/5513; Y10T 70/5518
USPC ..... 292/1.5, 169.12, 169.14, 169.15, 169.16, 292/169.18, 336.3, 336.5, 337, 347, 348, 292/350, 352, 358, 359, DIG. 27, 292/DIG. 44; 70/124, 467, 468, 470, 70/481, 482, 487, 488, 152, 153, 150
See application file for complete search history.

(56) References Cited

U.S. PATENT DOCUMENTS 1,021,864 A * 4/1912 Denzler ..... E05B 55/00 292/182
1,207,123 A * 12/1916 Arsneau ..... E05B 85/22 292/170
2,038,907 A * 4/1936 Schlage ..... E05C 1/163 292/1
2,497,328 A * 2/1950 Smith ..... E05B 55/005 292/169.18
2,497,329 A * 2/1950 Smith ..... E05C 1/163 292/169.14
2,604,346 A * 7/1952 Allen ..... E05B 1/0038 292/336.3
2,807,492 A * 9/1957 Jakeway ..... E05B 1/0038 292/336.3
3,057,649 A * 10/1962 Check ..... E05B 63/22 292/150
3,374,019 A * 3/1968 Sanowskis ..... E05C 1/14 292/170
4,296,956 A * 10/1981 Colombo ..... E05C 1/163 292/169
4,711,477 A * 12/1987 Fann ..... E05B 63/06 292/1.5
4,746,154 A * 5/1988 Fang ..... E05B 63/06 292/1
6,234,547 B1 5/2001 Ruffino

* cited by examiner

DOOR KNOB ASSEMBLY

FIELD AND BACKGROUND

The present invention relates generally to the field of door knobs and in particular to a new door knob assembly for allowing for a door to be opened easily without a user being forced to turn a door knob. The prior art contains many different door knobs and latches, most of which require that the door knob or latch be turned in order to achieve their objective.

SUMMARY

It is an object of the disclosed door knob assembly to facilitate the opening, closing, locking and unlocking of a door in a way which does not require a user to turn the door knob.

To achieve this objective, the disclosed assembly is used in conjunction with a door which has openings on its side edge, the inside surface and the outside surface. The openings on the inside and outside surface create a cavity through the width of the door. Similarly, the opening on the side edge of the door creates a cavity that extends into the side of the door until it meets up with the cavity created by the openings on the inside and outside surface. Therefore, all three openings in the door communicate with each other The disclosed door knob assembly further includes a stationery outside door knob which is placed in the opening on the outside surface of the door. When the disclosed door knob is fully assembled, the outside door knob connects and communicates with both an actuating inside door knob, which is placed in the opening on the inside surface of the door, as well as a locking body, which is placed in the opening on the side edge of the door. Covering the holes on both the inside and outside surfaces of the door are concentric escutcheons. The inside escutcheon is provided with two holes to accommodate fasteners used to connect the inside and outside door knobs. The outside door knob further includes two threaded coupling elements attached to the interior surface of the escutcheon. The coupling elements extend toward the opening on the inside surface and line up with the holes provided on the inside escutcheon.

The locking body located in the opening on the side edge of the door includes a hollow casing which has an open front end and a partially enclosed back end. It also includes a locking shaft which slides into the hollow casing. The locking shaft has a front locking head and two complementary engagement arms projecting out from a rear surface opposite the locking head. Also, the engagement arms extend through the partially enclosed back end of the hollow casing. Between the engagement arms is a centered longitudinal space which has at least one obstruction openings. Also, a spring is positioned between the rear surface of the locking shaft and the partially enclosed back end of the hollow casing. The locking body also includes a shaft housing located at the back of the hollow casing. It extends out from the partially enclosed back end and surrounds the engagement arms. The shaft housing also has centered openings which allow the threaded coupling elements to pass through so as to facilitate the attachment of the inside and outside door knobs.

The inside door knob is actuated by moving it between an extended and contracted position. A slidable bar is connected to and protrudes out from the back end of the inside door knob. The slidable bar has a depressible bearing on its outside surface. The inside escutcheon has a concentric bar sleeve at its center. The bar sleeve has a through hole which allows the slidable bar to pass through to the inside of the assembly. Also, the bar sleeve has a complementary divit on the inside surface of the through hole. When slidable bar passes through the hole in the bar sleeve the depressible bearing encounters the divit and thrusts up into it. This functions to hold the knob in the contracted position. Also, a locking rod is attached to the back end of the slidable bar. The locking rod extends through the at least one obstruction openings. A stop washer and a top nut are positioned at the point where the locking rod connects to the slidable bar. The stop washer prevents the slidable bar from sliding out of the bar sleeve when the knob is in the extended position. The top nut secures the stop washer to the back of the slidable bar. An adjustable coaxial locking nut is located further up the locking rod. When the disclosed door knob is fully assembled, the locking nut will be positioned in the obstruction openings of the locking shaft which will prevent the front locking head from sliding into the cylindrical casing and causes the door to be locked. Accordingly, when the inside knob is either extended or contracted, this moves the locking nut out of the obstruction openings and the door can be opened. Further, the inside escutcheon has two fastener holes which are aligned with the two threaded coupling elements.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION

Figure 1A:
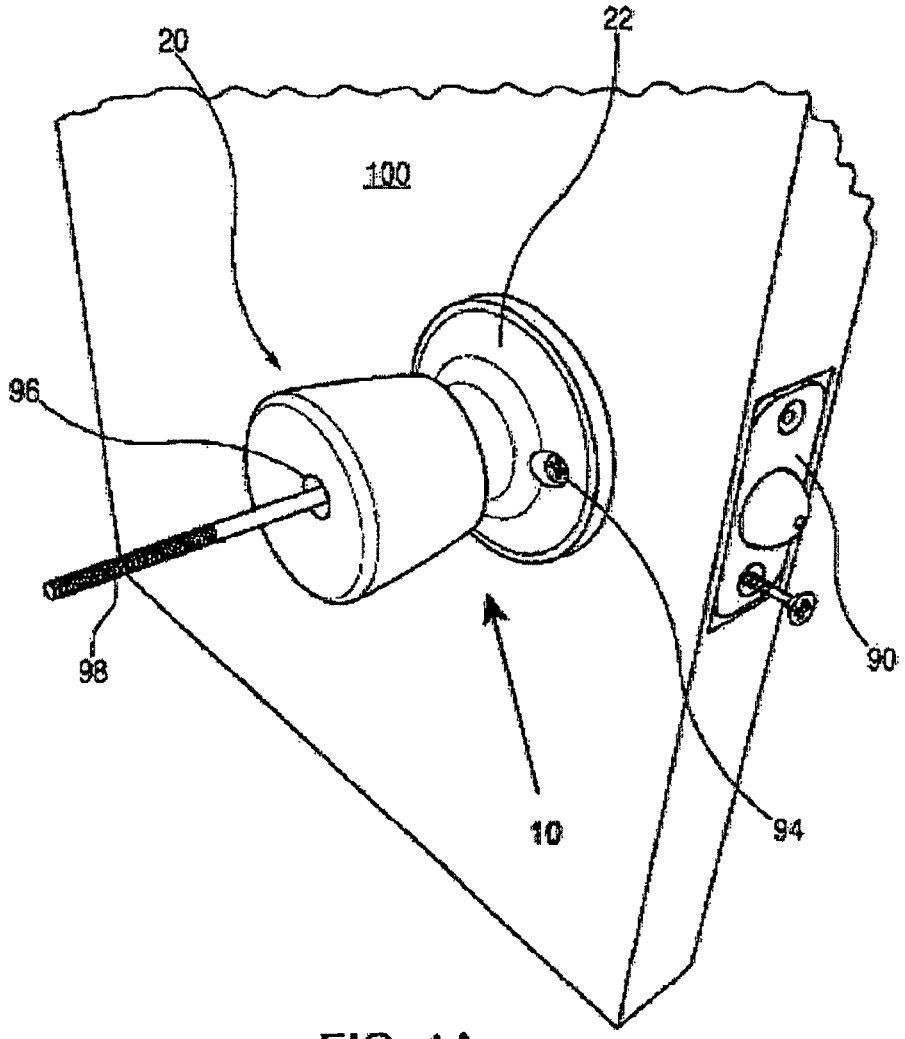
FIG. 1*a* is a perspective view of the assembled door knob assembly.
Figure 1B:
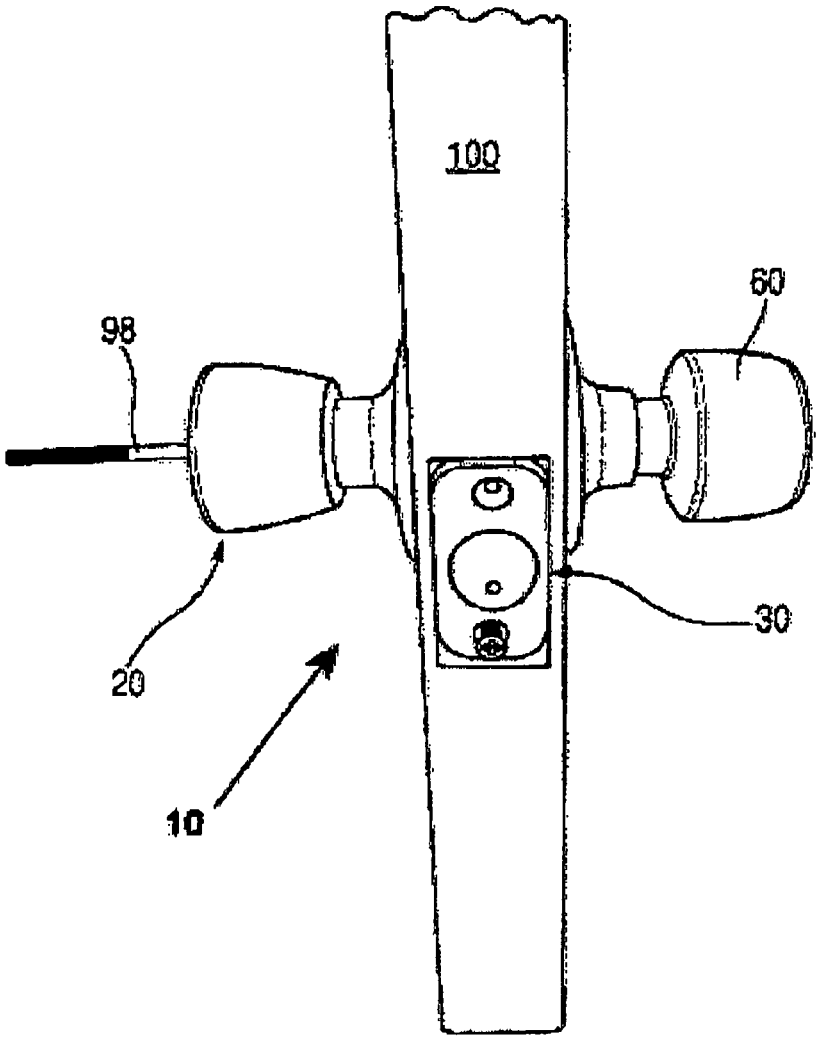
FIG. 1*b* is a side view of the assembled door knob assembly.

Referring now to the drawings, in which like reference numerals are used to refer to the same or similar elements, FIGS. 1A and 1B show the disclosed door knob assembly (10) fully assembled. The object of the disclosed assembly (10) is to allow someone to open, close, lock and unlock a door without having to turn a knob. Instead, this can be accomplished by simply pulling and/or pushing the knobs. For purposes of this application, the term "knob" includes all known knob/handle configurations. For example, a knob can be in the form of a lever like handle.

Additionally, the materials that the disclosed assembly (10) is typically made from are common metals and/or metal alloys. A non-exhaustive list of such materials are as follows. Aluminum, brass, copper and steel. However, the present assembly can be made from any material, now known or later developed, which have properties sufficient to allow it to achieve its intended function. An example of such a material is rigid plastic. Furthermore, unless otherwise described, all attachments between elements can be accomplished by a number of known methods. For example, male and female threading can be used. Another example would be when elements are fixed/connected with some form of adhesive. Moreover, elements can be spot welded together. Similarly, two adjacent elements can be unitary as would be the case if elements came out of the same mold.

FIGS. 1A and 1B show a door (100) having a side opening extending within a side edge thereof. The door (100) has openings on an inside surface and an outside surface thereof in communication with the side opening. Basically, the three holes in the door form a unitary cavity within which the fully assembled disclosed assembly (10) is fitted.

Figure 1C:
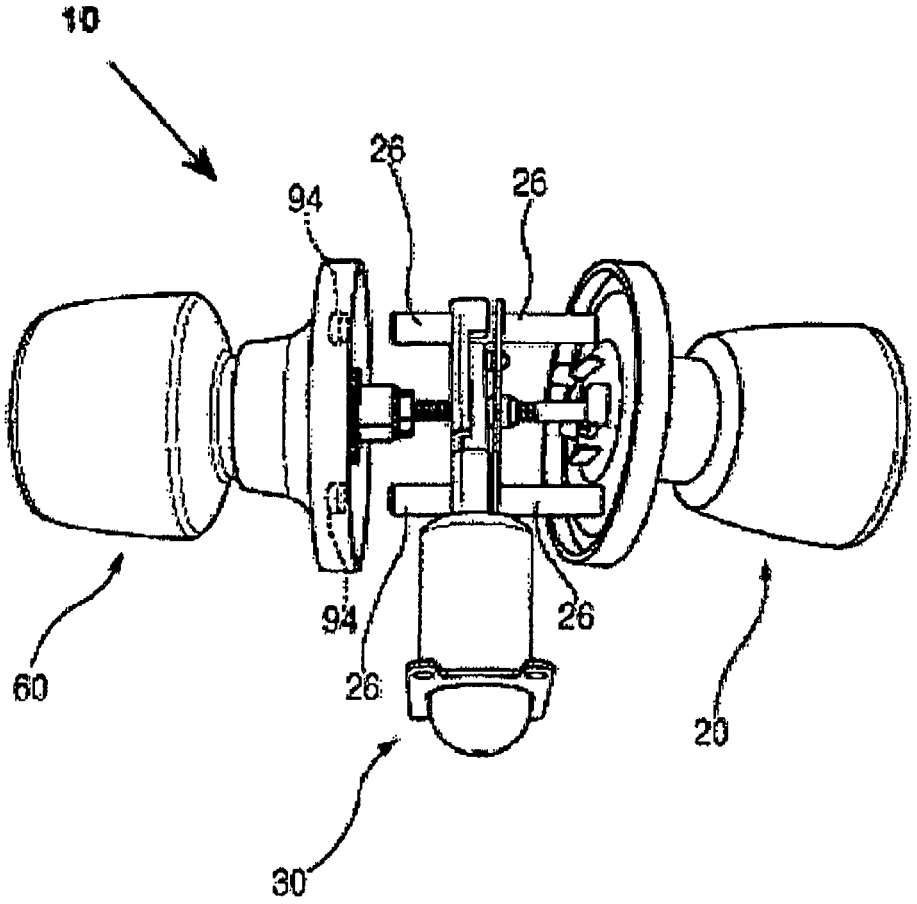
FIG. 1*c* is a top view of the partially assembled door knob assembly absent the door.

As shown in FIG. 1C, the present assembly (10) comprises a stationery outside door knob (20) slidably received within the opening in the outside surface of the door. At the point where the outside knob (20) contacts the door (100) there is a concentric outside escutcheon (22) which covers the portion of the opening in the outside surface which is not taken up by the knob (20) itself. The escutcheon (22) has an interior surface and two threaded coupling elements (26) are affixed thereto.

The coupling elements (26) extend toward the opening in the inside surface of the door. They function to meet up and attach to fasteners which extend from the opposite side of the door (see below). Together with the fasteners, the coupling elements (26) hold the components of the assembly (10) to each other and fit it tightly to the front and back surfaces of the door (100)

Additionally, the front of the outside knob (20) can comprise a centered hole (96) in which a key element (98) can be placed to unlock the door (100) from the outside.

Figure 2A:
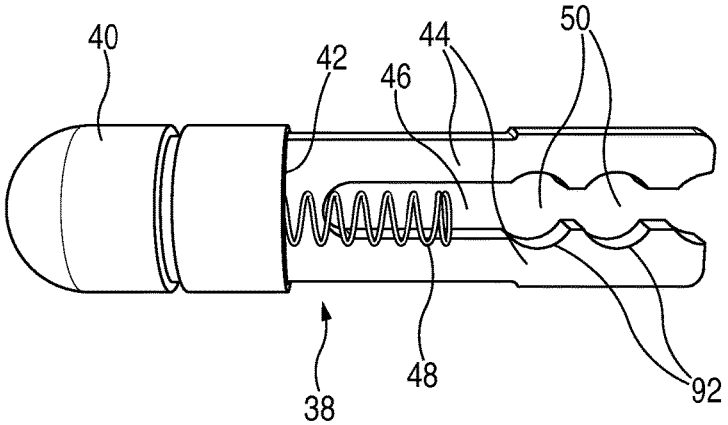
FIG. 2*a* is a side view of the locking shaft.
Figure 2B:
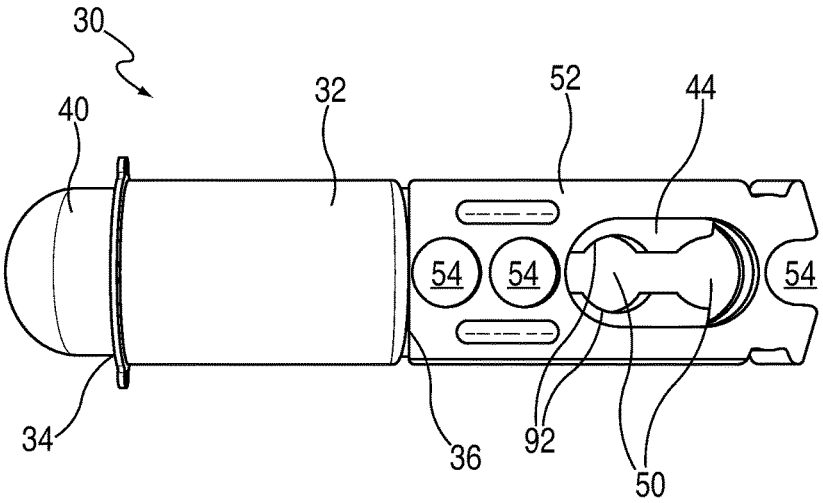
FIG. 2*b* is a side view of the locking body.

Referring now to FIG. 2B, the disclosed assembly (10) further comprises a locking body (30) which is disposed within the side opening of the door (100). The locking body (30) comprises, a hollow casing (32) which has an open front end (34) and partially enclosed back end (36). As shown in FIGS. 1A and 1B, the front portion of the hollow casing (32) can be fitted with a flange plate (90) which comprises screw holes which can be used to secure it to the side edge of the door (100). Additionally, a locking shaft (38) is slidably disposed within the hollow casing (32).

The hollow casing (32) shown in FIG. 2B is cylindrical. However, it could also be rectangular, square or any other shape which would allow it to functionally accommodate the locking shaft (38) and also facilitate linear motion. The locking shaft (38) has a front locking head (40) which protrudes out from the side edge of the door (100) and is designed to retract therein when the door is in the process of being opened or closed. FIGS. 1A through 2C show the locking head (40) as a dome shape. However, it can be shaped in any one of many configurations known in the art.

The locking shaft (38) also has two complementary engagement arms (44) extending out from the partially enclosed back end (36) of the hollow casing (32) toward a distal end. The engagement arms (44) comprise a centered longitudinal space (46) which is provided to allow unobstructed linear motion of the locking shaft (38) through the hollow casing and shaft housing (shown in FIG. 2B and described below). Fitted along the longitudinal space (46) are at least two obstruction openings (50) which in FIGS. 2A and 2B are formed by two juxtaposed grooves (92). FIG. 2A shows the engagement arms (44) as two separate arms. However, the engagement arms (44) can be made up of a unitary arm as would be the case if the arms were connected at their distal end.

Additionally, a spring (48) is positioned between the rear surface (42) of the locking shaft (38) and the partially enclosed back end (36) of the hollow casing (32). This keeps the locking head (40) in an extended position and also allows it to retract through the hollow casing (32) into the side edge of the door (100). The spring (48) can be fixedly attached to the rear surface of the locking head (40) or can be placed inside a circular recess and hence frictionally attached to the rear surface of the locking head (40).

The locking body (30) further comprises a shaft housing (52) which extends out from the partially enclosed back end (36) of the hollow casing (32) and surrounds the engagement arms (44). In addition, the shaft housing (52) has centered openings (54) to accept the threaded coupling elements (26) and allows them to pass though the shaft housing and the locking shaft's (38) longitudinal space (46) toward the opening on the opposite side of the door (100).

The complementary engagement arms have two sections. The first section is proximate the hollow casing (32). The second section is distal to the hollow casing (32) and is slightly thicker. Each of the two sections of the engagement arms (44) have a constant thickness. Thus, where the two sections of the engagement arms (44) meet (i.e., half way between the front and back end of the engagement arms) is a step on the outside edge of each engagement arm (44). The step is created by the immediate change in thickness of the two sections of the engagement arms (44). See FIG. 2A The partially enclosed back end (36) of the hollow casing (32) comprises a main rectangular opening which is just large enough to allow the engagement arms (44) to slide through and protrude out the back end (36) of the hollow casing (32). The main rectangular opening has bumped out notches provided on its edges which are positioned to accept the turned up flaps on each of the two pieces of the shaft housing (52) and are sized so that when the pieces of the shaft housing (52) are folded together, the shaft housing (52) becomes locked to the back end (36) of the hollow casing (32).

Also, the shaft housing (52) is made up of two pieces. Each of the two pieces have turned up flaps positioned where the shaft housing (52) attaches to the hollow casing (32). When the turned up flaps are placed in complementary holes in the back end of the hollow casing, it causes a strong yet manually removable attachment it to the casing (32). Also, each of the two pieces of the shaft housing (52) fold around the locking shaft (38) and lock together to create the functioning shaft housing (52). Adjacent the turned up flaps, there are two short side walls that tightly surround the thinner section of the engagement arms (44) and allow the thinner section to slide front and back within the shaft housing (52). However, the side walls are not far enough apart to allow the thicker portion of the engagement arms (44) to slide through. Thus, as the locking shaft (38) is pushed outward from the hollow casing (32) by the spring (48), It causes the engagement arms (44) to slide through the shaft housing (52) until the short side walls but up against the notch where the engagement arms (44) increase in thickness.

Figure 3A:
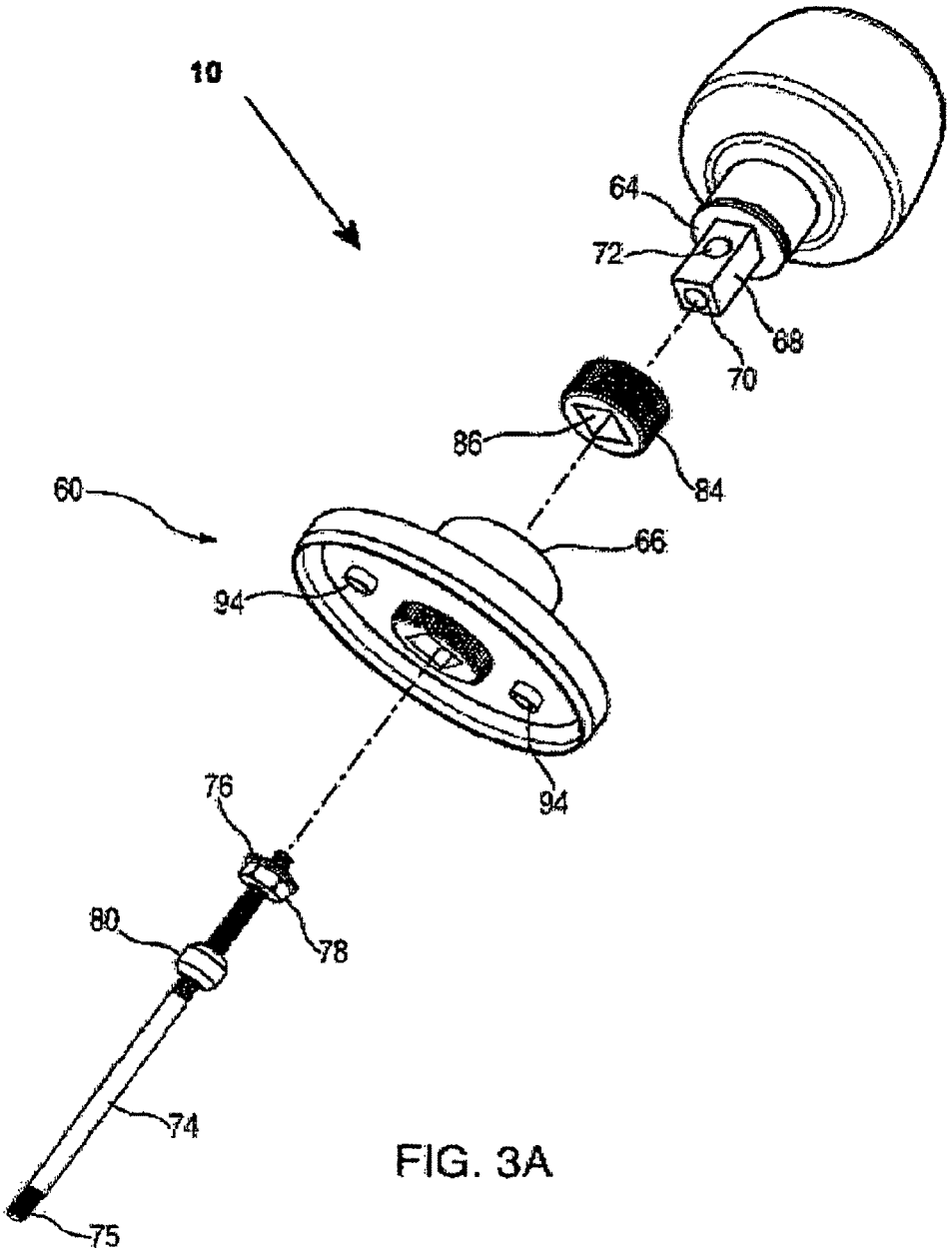
FIG. 3*a* is a an exploded view of the actuating inside door knob.
Figure 3B:
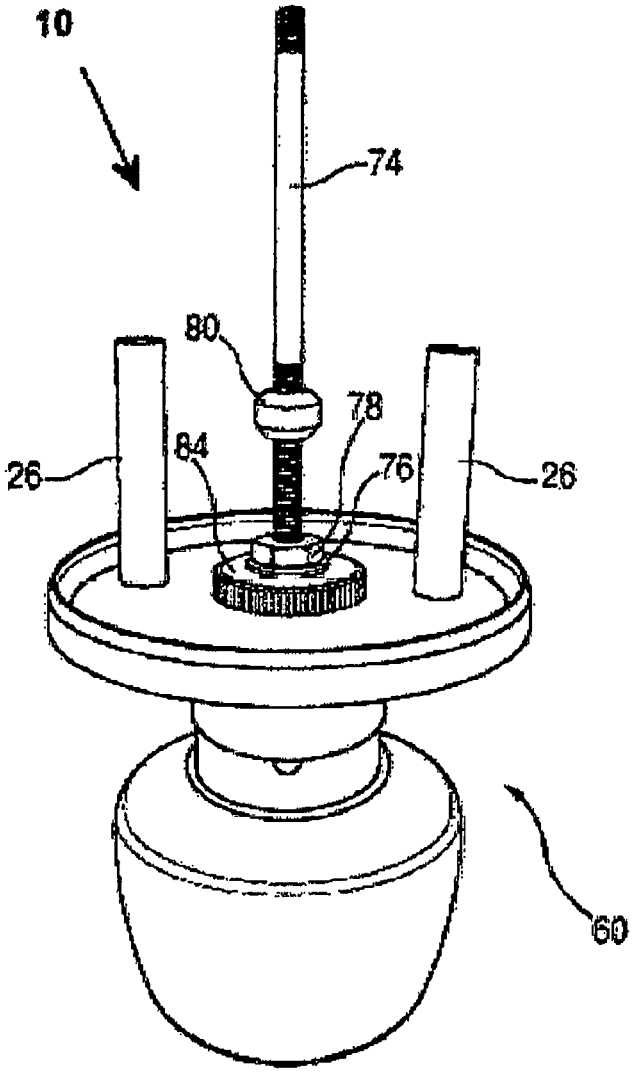
FIG. 3*b* is a side view of the inside door knob in the extended position.
Figure 3C:
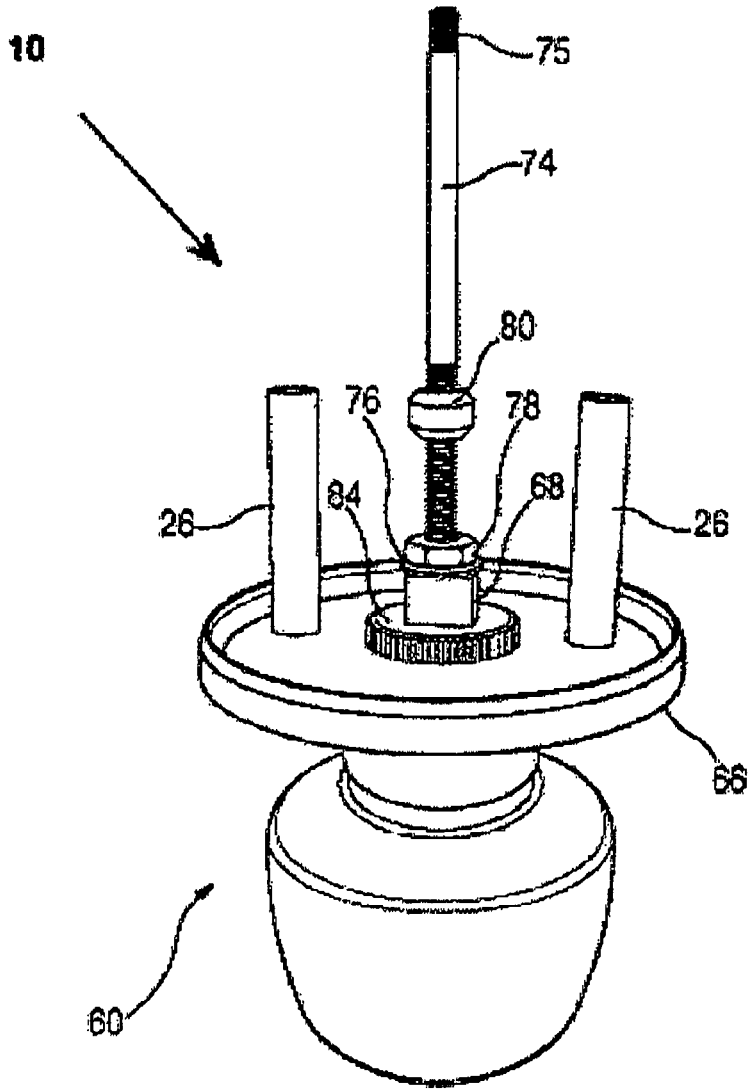
FIG. 3*c* is a side view of the inside door knob in the contracted position.

Referring now to FIGS. 3A through 3C, the disclosed assembly (10) also comprises an actuating inside door knob (60) which is slidably received within the opening in the inside surface of the door (100). The actuating inside door knob (60) has a front end (not shown in figures) and a back end (64). Also, a concentric inside escutcheon (66) provided with two fastener holes (94). The fastener holes (94) are meant to accommodate fasteners which connect with the coupling elements (26). A non exhaustive list of fasteners are screws and bolts. Alternatively, the present assembly (10) can be configured so the coupling elements (26) are attached to and extend out from the inside escutcheon (66) and the fastener holes can be oppositely located on the outside escutcheon (22) as shown in FIGS. 1A, 3B and 3C.

Additionally, connected to the back end (64) of the inside door knob (60) is a slidable bar (68). The slidable bar (68) has a front end and a back end (70). The front end of the bar (68) is fixed to the back end (64) of the inside door knob (60). It has a depressible bearing (72) which can retract into the bar when pressure is applied to it. Otherwise, constant upward force provided by an internal spring causes the bearing (72) to stay protruded.

A concentric bar sleeve (84) is fixedly attached to and concentrically positioned on the inside escutcheon (66). The sleeve (84) has a through hole which is sized slightly larger than the slidable bar (68) so that the bar (68) can pass through. The bar sleeve (84) has an inside surface (86). On the inside surface (86), and located in line with the depressible bearing (72), is a complementary divit (not shown in figures) for slidably accepting the depressible bearing (72).

A locking rod (74) is attached to the back end (70) of the slidable bar (68). It has a proximate end and a distal end (75). The locking rod (74) extends through the at least two obstruction openings (50) in the locking shaft (38). The locking rod (74) has a diameter which is smaller than the longitudinal space on the locking shaft (38). The locking rod (74) comprises male threading at the proximate end, its distal end (75) as well as on the portion of the rod (74) which extends through the obstruction openings (50). Alternatively, the locking rod (74) can be fully threaded.

As mentioned above and as shown in FIGS. 1A and 1B, a key element fitted with female threads at the end can be placed into a hole (96) on the front of the outside knob (20) to connect to the threaded distal end (75) of the locking rod (74). When a user then pushes or pulls the key element, it causes the locking rod to move and hence allows them to lock and or unlock the door (100).

A stop washer (76) is positioned at the proximate end of the locking rod (74). This is the point at which the locking rod (74) attaches to the slidable bar (68). Adjacent and distal to the stop washer (76) is a top nut (78) which functions to keep the stop washer (76) tight against the back end (70) of the slidable bar (68). The stop washer (76) prevents the slidable bar (68) from sliding out of the bar sleeve (84) when the inside knob (60) is pulled into an extended position. Accordingly, the stop washer (76) must be larger than the through hole in the bar sleeve (84).

The locking rod (74) further comprises an adjustable coaxial locking nut (80) distal to the top nut (78). It is sized small enough to fit through the obstruction openings (50) but too large to fit through the centered longitudinal space (46). The locking nut (80) is adjustable and can be positioned at different points along the locking rod (74). That is, it can be positioned so that it is either in front (i.e., closer to the outside surface of the door) or in back (i.e., closer to the inside surface of the door) of the locking shaft (38). When the locking nut (80) is moved into one of the obstruction openings (50) the locking shaft cannot slide and hence the locking head (40) cannot retract into the side edge of the door (100). At this point, the door (100) is locked.

Furthermore, as shown in FIGS. 3B and 3C, the inside knob (60) can be actuated into either an extended position (FIG. 3B) or a contracted position (FIG. 3C). This changes the position of the locking rod (74) and hence the locking nut (80) with respect to the obstruction openings (50). Accordingly, the lock nut (80) can be positioned on the locking rod (74) so that when the inside knob (60) is pulled into an extended position, the locking nut (80) moves into the obstruction openings (50) and locks the door (100). As mentioned above, this would happen if the locking nut (80) was positioned closer to the outside surface of the door (100). By contrast, the locking nut (80) can be positioned closer to the inside surface of the door (100) on the locking rod (74). In this case, when the inside knob (60) is pushed into the contracted position, the locking nut (80) will move into the obstruction openings (50) and lock the door (100).

While specific embodiments of the invention have been shown and described in detail to illustrate the application of the principles of the invention, it will be understood that the invention may be embodied otherwise without departing from such principles.

What is claimed is:

1. A door knob assembly comprising:

a door having a side opening extending within a side edge thereof, the door having openings through an inside surface and an outside surface thereof in communication with the side opening;

a stationery outside door knob slidably received within the opening in the outside surface of the door, the stationery outside door knob comprising a concentric outside escutcheon having an interior surface and two threaded coupling elements fixed to the interior surface, the two threaded coupling elements extending toward the opening in the inside surface of the door;

a locking body disposed within the side opening of the door, the locking body comprising, a hollow casing having an open front end and a partially enclosed back end, a locking shaft slidably disposed within the hollow casing, the locking shaft having a front locking head, a rear surface, two complementary engagement arms extending out from the partially enclosed back end, the two complementary engagement arms comprising a centered longitudinal space and a spring positioned between the rear surface of the locking shaft and the partially enclosed back end of the hollow casing, the longitudinal space having at least one obstruction opening, the locking body further comprising a shaft housing extending out from the partially enclosed back end and surrounding the two complementary engagement arms, the shaft housing comprising centered openings to accept the two threaded coupling elements; and an actuating inside door knob slidably received within the opening in the inside surface of the door, the actuating inside door knob comprising a front end, a back end, an concentric inside escutcheon provided with two fastener holes aligned with the two threaded coupling elements, a slidable bar comprising a back end fixed to the back end of the actuating inside door knob, the slidable bar comprising a depressible bearing, a locking rod is attached to the back end of the slidable bar, the locking rod comprising a distal end extending through the at least one obstruction opening in the locking shaft, the locking rod comprising a stop washer and a top nut fitted at the back end of the slidable bar, the locking rod further comprising an adjustable coaxial locking nut distal to the top nut, the actuating inside door knob further comprising a concentric bar sleeve fixedly attached to and concentrically positioned on the concentric inside escutcheon, the concentric bar sleeve comprising a through hole with an inside surface, the inside surface is provided with a complementary divit for slidably accepting the depressible bearing the stationary outside door knob further comprising a centered hole, through which a key element can be fitted and attached to the distal end of the locking rod so as to facilitate unlocking of the door knob assembly from the outside, the key element and the distal end of the locking rod are fitted with complementary male and female threading.

2. A door knob assembly as claimed in claim 1, wherein the two complementary engagement arms comprise two separate adjacent arms, and the at least one obstruction opening consists of 6 complementary juxtaposed grooves.

3. A door knob assembly as claimed in claim 1, wherein the hallow casing further comprises a flange plate fixed to the open front end for fastening the locking body into the side opening of the door.

4. A door knob assembly as claimed in claim 1, wherein the front locking head and the locking shaft are unitary.

* * * * *